US009666991B2

(12) United States Patent
Davis

(10) Patent No.: US 9,666,991 B2
(45) Date of Patent: May 30, 2017

(54) HEADER TRANSITION CONNECTOR FOR AN ELECTRICAL CONNECTOR SYSTEM

(71) Applicant: Tyco Electronics Corporation, Berwyn, PA (US)

(72) Inventor: Wayne Samuel Davis, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 28 days.

(21) Appl. No.: 14/182,125

(22) Filed: Feb. 17, 2014

(65) Prior Publication Data

US 2015/0236450 A1 Aug. 20, 2015

(51) Int. Cl.
*H01R 12/00* (2006.01)
*H01R 13/6581* (2011.01)
*H01R 12/71* (2011.01)

(52) U.S. Cl.
CPC ..... *H01R 13/6581* (2013.01); *H01R 12/71* (2013.01)

(58) Field of Classification Search
CPC ..... H01R 23/688
USPC ..... 439/78, 626, 605–606
See application file for complete search history.

(56) References Cited

U.S. PATENT DOCUMENTS 6,540,522 B2 * 4/2003 Sipe ..... H01R 13/6658 439/607.05
6,663,429 B1 * 12/2003 Korsunsky ..... H01R 23/688 439/108
6,692,305 B2 * 2/2004 Nelson ..... H01R 13/518 439/607.07
6,899,566 B2 * 5/2005 Kline ..... H01R 13/514 439/108
7,758,385 B2 * 7/2010 Davis ..... H01R 23/688 439/626
7,988,456 B2 8/2011 Davis et al.
(Continued)

FOREIGN PATENT DOCUMENTS

DE 10152439 A1 5/2003
EP 0907225 A2 4/1999
EP 1049201 A1 11/2000

OTHER PUBLICATIONS

International Search Report, International Application No. PCT/US2015/14784, International Filing Date Feb. 6, 2015.

*Primary Examiner* — Abdullah Riyami
*Assistant Examiner* — Thang Nguyen

(57) ABSTRACT

A header transition connector includes a header housing having a first end and a second end with a separating wall separating a first cavity from a second cavity. The separating wall has signal contact openings and ground shield openings therethrough. Header signal contacts are held in corresponding signal contact openings and arranged in pairs carrying differential signals. The header signal contacts have first mating ends in the first cavity and second mating ends in the second cavity for mating with first and second receptacle connectors, respectively. Header ground shields are held in corresponding ground shield openings and have walls surrounding associated pairs of header signal contacts on at least two sides thereof. The header ground shields have first mating ends in the first cavity and second mating ends in the second cavity for mating with the first and second receptacle connectors, respectively.

19 Claims, 6 Drawing Sheets

(56) References Cited

U.S. PATENT DOCUMENTS

| | | | | |
|---|---|---|---|---|
| 8,371,876 | B2 * | 2/2013 | Davis | H01R 12/724 439/108 |
| 8,430,691 | B2 * | 4/2013 | Davis | H01R 13/6585 439/607.09 |
| 8,449,330 | B1 * | 5/2013 | Schroll | H01R 13/514 439/607.06 |
| 8,628,356 | B2 * | 1/2014 | Laurx | H01R 12/737 439/628 |
| 8,641,448 | B2 * | 2/2014 | Lappoehn | H01R 13/737 439/607.09 |
| 8,870,594 | B2 * | 10/2014 | McClellan | H01R 9/22 439/607.05 |
| 2007/0270001 | A1 * | 11/2007 | Matsumura | H01R 12/585 439/82 |
| 2012/0058655 | A1 * | 3/2012 | Chien | H01R 12/585 439/78 |
| 2012/0220170 | A1 * | 8/2012 | Pan | H01R 13/719 439/660 |
| 2012/0264334 | A1 | 10/2012 | Laurx et al. | |
| 2013/0210246 | A1 | 8/2013 | Davis et al. | |
| 2013/0280957 | A1 | 10/2013 | Davis et al. | |
| 2014/0051295 | A1 * | 2/2014 | Westman | H01R 13/514 439/626 |
| 2015/0031238 | A1 * | 1/2015 | Davis | H01R 23/688 439/607.05 |

* cited by examiner

HEADER TRANSITION CONNECTOR FOR AN ELECTRICAL CONNECTOR SYSTEM

BACKGROUND OF THE INVENTION

The subject matter herein relates generally to a header transition connector for use in an electrical connector system.

Some electrical systems, such as network switches and computer servers with switching capability, include receptacle connectors that are oriented orthogonally on opposite sides of a midplane in a cross-connect application. Switch cards may be connected on one side of the midplane and line cards may be connected on the other side of the midplane. The line card and switch card are joined through header connectors that are mounted on opposite sides of the midplane board. Using the midplane circuit board and header connectors adds to the cost and overall size of the electrical systems. Some known electrical systems have eliminated the midplane and header connectors by designing two connectors that mate directly to one another. However, such systems require one or both of the connectors to be retooled at great expense. Also the designs of such connectors are complicated and expensive.

A need remains for an improved electrical connector system for mating receptacle connectors without a midplane circuit board.

BRIEF DESCRIPTION OF THE INVENTION

In one embodiment, a header transition connector is provided including a header housing having a first end and a second end. The header housing has a separating wall separating a first cavity from a second cavity at the first and second ends, respectively. The separating wall has signal contact openings and ground shield openings therethrough. Header signal contacts are held in corresponding signal contact openings and arranged in pairs carrying differential signals. The header signal contacts have first mating ends in the first cavity for mating with a first receptacle connector and second mating ends in the second cavity for mating with a second receptacle connector. Header ground shields are held in corresponding ground shield openings. The header ground shields have walls surrounding associated pairs of header signal contacts on at least two sides thereof. The header ground shields have first mating ends in the first cavity for mating with the first receptacle connector and second mating ends in the second cavity for mating with the second receptacle connector.

In another embodiment, an electrical connector system is provided that includes a receptacle connector and a header transition connector. The receptacle connector includes a receptacle housing and contact modules coupled to the receptacle housing. The contact modules each include receptacle signal contacts arranged in pairs carrying differential signals. The contact modules each include a ground shield having ground contacts extending therefrom and providing electrical shielding for associated pairs of the receptacle signal contacts. The receptacle signal contacts are arranged in an array in rows and columns having a predetermined pinout. The receptacle signal contacts are split beam type contacts defining receptacles configured to receive pin type contacts. The ground contacts, receptacle signal contacts and receptacle housing define a mating interface. The header transition connector is coupled to the receptacle connector and includes a header housing holding header signal contacts and header ground shields. The header housing has a first end and a second end with a separating wall separating a first cavity from a second cavity. The receptacle connector is received in the first cavity. The separating wall has signal contact openings receiving corresponding header signal contacts and ground shield openings receiving corresponding header ground shields. The header signal contacts are arranged in pairs carrying differential signals. The header signal contacts have first mating ends defining pin type contacts in the first cavity for mating with the receptacle signal contacts of the receptacle connector and second mating ends defining pin type contacts in the second cavity. The header ground shields have walls surrounding associated pairs of header signal contacts on at least two sides thereof. The header ground shields have first mating ends in the first cavity for mating with the ground contacts of the receptacle connector and second mating ends in the second cavity for mating with a second receptacle connector. The header signal contacts are arranged in an array in rows and columns having a pinout that is complementary to the pinout of the receptacle signal contacts. The second mating ends of the header ground shields, the second mating ends of the header signal contacts, and the header housing define a mating interface that is different than the mating interface defined by the receptacle connector and configured to be mated with the second receptacle connector.

In a further embodiment, an electrical connector system is provided that includes a header transition connector having a header housing holding header signal contacts and header ground shields. The header housing has a first end and a second end and a separating wall separating a first cavity from a second cavity at the first and second ends, respectively. The separating wall has signal contact openings receiving corresponding header signal contacts and ground shield openings receiving corresponding header ground shields. The header signal contacts are arranged in pairs carrying differential signals. The header signal contacts have first mating ends in the first cavity and second mating ends in the second cavity. The header ground shields have walls surrounding associated pairs of header signal contacts on at least two sides thereof. The header ground shields have first mating ends in the first cavity and second mating ends in the second cavity. A first receptacle connector is received in the first cavity and a second receptacle connector received in the second cavity. The first receptacle connector has first receptacle signal contacts mated with the first mating ends of corresponding header signal contacts. The first receptacle connector has first ground contacts mated with the first mating ends of corresponding header ground shields. The second receptacle connector has second receptacle signal contacts mated with the second mating ends of corresponding header signal contacts. The second receptacle connector has second ground contacts mated with the second mating ends of corresponding header ground shields.

DETAILED DESCRIPTION OF THE INVENTION

Figure 1:
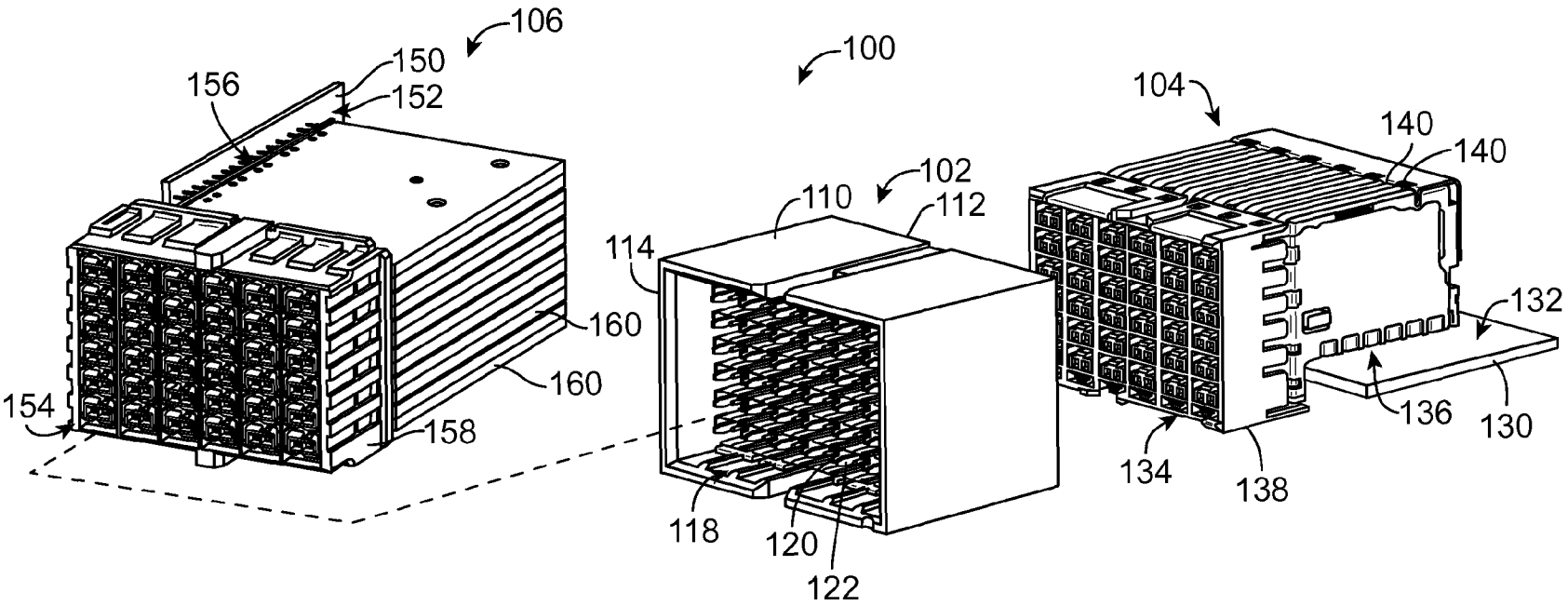
FIG. 1 is a perspective view of an electrical connector system formed in accordance with an exemplary embodiment.

FIG. 1 is a perspective view of an electrical connector system 100 formed in accordance with an exemplary embodiment. The electrical connector system 100 includes a header transition connector 102, a first receptacle connector 104 configured to be coupled to one side of the header transition connector 102 and a second receptacle connector 106 configured to be connected to a second side the header transition connector 102. The header transition connector 102 is used to electrically connect the first and second receptacle connectors 104, 106. Optionally, the first receptacle connector 104 may be part of a daughter card and the second receptacle connector 106 may be part of a backplane, or vice versa. The first and second receptacle connectors 104, 106 may be part of line cards or switch cards.

The header transition connector 102 makes direct electrical connections to both receptacle connectors 104, 106 without the need for a midplane circuit board. The header transition connector 102 is a single connector that is able to electrically connect the two receptacle connectors 104, 106. The receptacle connectors 104, 106 may be any type of receptacle connectors, such as STRADA Whisper® receptacle connectors commercially available from TE Connectivity, Harrisburg Pa. The header transition connector 102 allows convenient electrical connection between the receptacle connectors 104, 106, with few parts and without the need for a midplane circuit board.

In an exemplary embodiment, the header transition connector 102 may be coupled to one of the receptacle connectors, such as the first receptacle connector 104, to change the mating interface presented to the second receptacle connector 106. For example, the first receptacle connector 104 may have contacts each having a receptacle type mating end, such as a split beam type of contact that defines a receptacle. The second receptacle connector 106 may have similar or identical contacts as the first receptacle connector 104, such as split beam type of contacts that define receptacles. The first and second receptacle connectors 104, 106 have mating interfaces that do not allow direct mating therebetween; however the header transition connector 102 is able to mate directly with the first receptacle connector 104 and directly with the second receptacle connector 106. The header transition connector 102 is an adaptor that facilitates electrical connection of the first and second receptacle connectors 104, 106. For example, the header transition connector 102 may include pin-type contacts at both mating interfaces of the header transition connector 102 that are able to be mated with the receptacle type contacts of the first and second receptacle connectors 104, 106. Mounting the header transition connector 102 to the first receptacle connector 104 changes the mating interface presented to the second receptacle connector 106 from a receptacle contact type of interface to a pin contact type of interface. The header transition connector 102 thus defines an adapter that changes the mating interface of the receptacle connector 104 for mating with another type of mating connector, such as the receptacle connector 106.

The header transition connector 102 includes a header housing 110 having a first end 112 and a second end 114. The header housing 110 defines a first cavity 116 (shown in FIG. 4) at the first end 112 and a second cavity 118 at the second end 114. The first cavity 116 receives the first receptacle connector 104 and the second cavity 118 receives the second receptacle connector 106. The header transition connector 102 includes header signal contacts 120 held by the header housing 110 and header ground shields 122 held by the header housing 110. The header signal contacts 120 are arranged in the first and second cavities 116, 118 for mating with the first and second receptacle connectors 104, 106. Optionally, the header signal contacts 120 may be arranged in pairs carrying differential signals. The header ground shields 122 are arranged in the first and second cavities 116, 118 for mating with the first and second receptacle connectors 104, 106. The header ground shields 122 provide electrical shielding for the header signal contacts 120.

In an exemplary embodiment, the header signal contacts 120 have an identical pinout in both the first and second cavities 116, 118 allowing the first receptacle connector 104 to be loaded into either the first cavity 116 or the second cavity 118. Similarly, the second receptacle connector 106 may be loaded into either the first cavity 116 or the second cavity 118. Optionally, identical receptacle connectors may be loaded into both cavities 116, 118 for electrical connection by the header transition connector 102. For example, two receptacle connectors that are identical to the first receptacle connector 104 (which may be referred to as pair-in-row receptacle connectors 104) may be plugged into the cavities 116, 118 in both ends 112, 114. Alternatively, two receptacle connectors that are identical to the second receptacle connector 106 (which may be referred to as pair-in-column receptacle connectors 106) may be plugged into the cavities 116, 118 in both ends 112, 114. The header transition connector 102 can accommodate either type of receptacle connector 104 or 106 in either cavity 116, 118.

Each of the header ground shields 122 peripherally surrounds an associated pair of the header signal contacts 120. In an exemplary embodiment, the header ground shields 122 are C-shaped, covering three sides of the associated pair of header signal contacts 120. One side of the header ground shield 122 is open. In the illustrated embodiment, each of the header ground shields 122 has an open bottom, and an adjacent header ground shield 122 below the open bottom provides shielding across the open bottom. Each pair of header signal contacts 120 is therefore surrounded on all four sides thereof by the associated C-shaped header ground shield 122 and the adjacent header ground shield 122 below the pair of header signal contacts 120. As such, the header ground shields 122 cooperate to provide circumferential electrical shielding for each pair of header signal contacts 120. The header ground shields 122 electrically shield each pair of header signal contacts 120 from every other pair of header signal contacts 120. For example, the header ground shields 122 may span all direct line paths from any one pair of the header signal contacts 120 to any other pair of the header signal contacts 120 to provide electrical shielding across all of the direct line paths. In an exemplary embodiment, the header ground shield 122 spans entirely across the top of both header signal contacts within the associated pair. The header ground shield 122 provides better electrical shielding than individual header ground contacts of conventional header assemblies.

In alternative embodiments, other types of header ground shields 122 may be provided. For example, L-shaped header ground shields 122 may be used that provide shielding on two sides of the associated pair of header signal contacts 120; however, in cooperation with other header ground shields 122, electrical shielding is provided on all sides (e.g. above, below and on both sides of the pair). In other alternative embodiments, the header ground shields 122 may be associated with individual header signal contacts 120 as opposed to pairs of header signal contacts 120.

The first receptacle connector 104 is mounted to a first circuit board 130 at a mounting surface 132 of the first circuit board 130. The first receptacle connector 104 has a header interface 134 configured to be mated with the header transition connector 102. The first receptacle connector 104 has a board interface 136 configured to be mounted to the mounting surface 132 of the first circuit board 130. In an exemplary embodiment, the board interface 136 is orientated perpendicular with respect to the header interface 134. When the first receptacle connector 104 is coupled to the header transition connector 102, the first circuit board 130 is orientated horizontally with the first receptacle connector 104 above the first circuit board 130; however other orientations are possible in alternative embodiments.

The first receptacle connector 104 includes a first receptacle housing 138 used to hold a plurality of first contact modules 140. The contact modules 140 are held in a stacked configuration generally parallel to one another. In the illustrated embodiment, the contact modules 140 are oriented generally along vertical planes. The contact modules 140 hold a plurality of first receptacle signal contacts 142 (shown in FIG. 2) that are electrically connected to the first circuit board 130 and define signal paths through the first receptacle connector 104. The receptacle signal contacts 142 are configured to be electrically connected to the header signal contacts 120. In an exemplary embodiment, the contact modules 140 provide electrical shielding for the receptacle signal contacts 142. Optionally, the receptacle signal contacts 142 may be arranged in pairs carrying differential signals. In an exemplary embodiment, the contact modules 140 generally provide 360° shielding for each pair of receptacle signal contacts 142 along substantially the entire length of the receptacle signal contacts 142 between the board interface 136 and the header interface 134. The shield structure of the contact modules 140 that provides the electrical shielding for the pairs of receptacle signal contacts 142 is electrically connected to the header ground shields 122 and is electrically connected to a ground plane of the first circuit board 130.

In an exemplary embodiment, mating ends of the receptacle signal contacts 142 are arranged in an array in rows and columns (contained within the receptacle housing 138 and thus not shown in FIG. 1; however the pattern is evident from the arrangement of the openings in the receptacle housing 138). The receptacle signal contacts 142 within each contact module 140 define a column of signal contacts. The rows are defined as being oriented parallel to the mounting surface 132 of the first circuit board 130. In the illustrated embodiment, the columns are oriented vertically and the rows are oriented horizontally. The receptacle signal contacts 120 within each pair are arranged in a same row, and thus the first receptacle connector 104 defines a pair-in-row receptacle connector. The receptacle signal contacts 120 within each contact module 140 are in a same column. In an exemplary embodiment, the contact modules 140 are manufactured using overmolded leadframes and the receptacle signal contacts 120 from the same leadframe are each within the same column. The receptacle signal contacts 142 within each pair are arranged in different contact modules 140.

The second receptacle connector 106 is mounted to a second circuit board 150 at a mounting surface 152 of the second circuit board 150. The second receptacle connector 106 is configured to be coupled to the header transition connector 102. The second receptacle connector 106 has a header interface 154 configured to be mated with the header transition connector 102. The second receptacle connector 106 has a board interface 156 configured to be mounted to the mounting surface 152 of the second circuit board 150. In an exemplary embodiment, the board interface 156 is orientated perpendicular with respect to the header interface 154. When the second receptacle connector 106 is coupled to the header transition connector 102, the second circuit board 150 is orientated vertically with the second receptacle connector 106 along one side of the second circuit board 150; however other orientations are possible in alternative embodiments. In an exemplary embodiment, the second circuit board 150 is oriented perpendicular to the first circuit board 130.

The second receptacle connector 106 includes a second receptacle housing 158 used to hold a plurality of second contact modules 160. The contact modules 160 are held in a stacked configuration generally parallel to one another. In the illustrated embodiment, the contact modules 160 are oriented generally along horizontal planes. The contact modules 160 hold a plurality of receptacle signal contacts 162 (shown in FIG. 3) that are electrically connected to the second circuit board 150 and define signal paths through the second receptacle connector 106. The receptacle signal contacts 162 are configured to be electrically connected to the header signal contacts 120. In an exemplary embodiment, the contact modules 160 provide electrical shielding for the receptacle signal contacts 162. Optionally, the receptacle signal contacts 162 may be arranged in pairs carrying differential signals. In an exemplary embodiment, the contact modules 160 generally provide 360° shielding for each pair of receptacle signal contacts 162 along substantially the entire length of the receptacle signal contacts 162 between the board interface 156 and the header interface 154. The shield structure of the contact modules 160 that provides electrical shielding for the pairs of receptacle signal contacts 162 is electrically connected to the header ground shields 122 of the header transition connector 102 and is electrically connected to a ground plane of the second circuit board 150.

In an exemplary embodiment, mating ends of the receptacle signal contacts 162 are arranged in an array in rows and columns (contained within the receptacle housing 158 and thus not shown in FIG. 1; however the pattern is evident from the arrangement of the openings in the receptacle housing 158). The receptacle signal contacts 162 within each contact module 160 define a column of signal contacts. The rows are defined as being oriented parallel to the mounting surface 152 of the second circuit board 150. In the illustrated embodiment, the columns are oriented horizontally and the rows are oriented vertically. The receptacle signal contacts 142 within each pair are arranged in a same column, and thus the second receptacle connector 106 defines a pair-in-column receptacle connector. The receptacle signal contacts 142 within each contact module 160 are in a same column. In an exemplary embodiment, the contact modules 160 are manufactured using overmolded leadframes and the receptacle signal contacts 142 from the same leadframe are each within the same column. The receptacle signal contacts 142 within each pair are arranged in the same contact module 160; which is contrary to the pair-in-row receptacle connector 104 where the receptacle signal contacts 142 within each pair are arranged in different contact modules 140.

Figure 2:
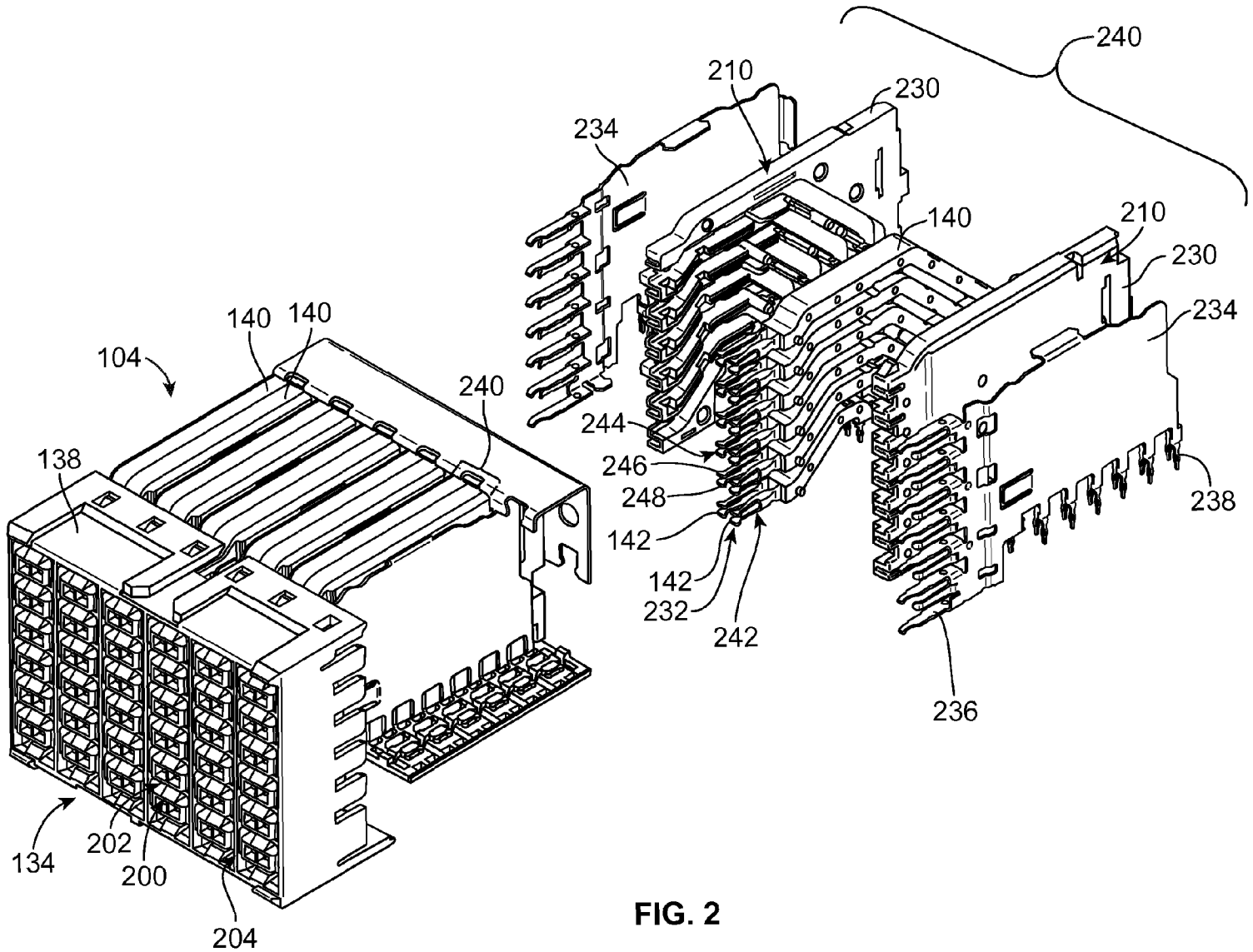
FIG. 2 is a front, exploded perspective view of a first receptacle connector of the electrical connector system formed in accordance with an exemplary embodiment.

FIG. 2 is a front, exploded perspective view of the first receptacle connector 104 formed in accordance with an exemplary embodiment. FIG. 2 illustrates a pair of contact modules 140 coupled together as a module unit 240 and poised for assembly and loading into the first receptacle housing 138. The first receptacle housing 138 is manufactured from a dielectric material, such as a plastic material. The first receptacle housing 138 includes a plurality of signal contact openings 200 and a plurality of ground contacts openings 202 that are through passages extending from the mating end 204 through the first receptacle housing 138. The mating end 204 defines a portion of the header interface 134 of the first receptacle connector 104.

The contact modules 140 are coupled to the first receptacle housing 138 such that the receptacle signal contacts 142 are received in corresponding signal contact openings 200. Optionally, a single receptacle signal contact 142 is received in each signal contact opening 200. The signal contact openings 200 may also receive corresponding header signal contacts 120 (shown in FIG. 1) therein when the receptacle connector 104 is coupled to the header transition connector 102 (shown in FIG. 1).

The ground contact openings 202 receive corresponding header ground shields 122 (shown in FIG. 1) therein when the receptacle connector 104 is coupled to the header transition connector 102. The ground contact openings 202 receive grounding members, such as grounding contacts 236 of the contact modules 140, which mate with the header ground shields 122 to electrically common the grounding contacts 236 and the header ground shields 122. The ground contact openings 202 are C-shaped in the illustrated embodiment to receive the C-shaped header ground shields 122. Other shapes are possible in alternative embodiments, such as when other shaped header ground shields 122 are used.

The contact modules 140 each include a holder 210 that holds a frame assembly 220. Optionally, the holder 210 may be a conductive holder to provide electrical shielding, such as a holder manufactured from a metal material or a metalized plastic material. The frame assembly 220 includes a dielectric frame 230 surrounding a leadframe 232. The dielectric frame 230 may be overmolded over the leadframe 232. The leadframe 232 is stamped and formed to define the receptacle signal contacts 142. Other manufacturing processes may be utilized to form the contact modules 140. The conductive holder 210 provides electrical shielding for the receptacle signal contacts 142. The conductive holder 210 may include portions that are positioned between some or all of the receptacle signal contacts to provide electrical shielding. Optionally, a shield 234 may be coupled to the holder 210. The shield 234 includes the grounding contacts 236 and grounding pins 238, which may be electrically terminated to the circuit board 130.

In an exemplary embodiment, the contact modules 140 may be formed as an A module and a B module that are coupled together to form the module unit 240 that may be loaded into the first receptacle housing 138. For example, the A and B modules may be complementary or mirrored halves. Alternatively, each of the contact modules may be identical and loaded separately into the first receptacle housing 138. Optionally, the shield 234 may be coupled to the A module but not the B module, or vice versa. Alternatively, shields 234 may be coupled to both the A and B modules.

The receptacle signal contacts 142 have mating portions 242 extending from the front wall of the dielectric frame 230. The mating portions 242 are configured to be mated with, and electrically connected to, corresponding header signal contacts 120 (shown in FIG. 1). The mating portions 242 within each contact module 140 are arranged in a column. The mating portions 242 define receptacle type mating ends having a receptacle 244 that is configured to receive a pin type contact, such as the header signal contact 120. In the illustrated embodiment, each mating portion 242 is a split beam type of contact having opposed beams 246, 248 defining and flanking the receptacle 244. Other types of mating portions may be provided in alternative embodiments.

The mating portions 242, grounding contacts 236 and first receptacle housing 138 together define the header interface 134. For example, the size and shape of the perimeter of the first receptacle housing 138 as well as the shapes and positions of the mating portions 242 and grounding contacts 236 define the header interface 134. For example, the mating portions 242 have a predetermined pinout defined by the relative positions of the mating portions 242. The header interface 134 is configured for mating with the header transition connector 102 (shown in FIG. 1).

In an exemplary embodiment, the receptacle signal contacts 142 are arranged as differential pairs. In an exemplary embodiment, one of the receptacle signal contacts 142 of each pair is held by one of the contact modules 140 of the module unit 240 while the other receptacle signal contact 142 of the differential pair is held by the other contact module 140 of the module unit 240. The pair of receptacle signal contacts 142 is arranged in a row, which defines the receptacle connector 104 as a pair-in-row receptacle connector 104. The receptacle signal contacts 142 of the pairs are held in different columns. In an exemplary embodiment, the conductive holders 210 are designed to provide electrical shielding between and around respective pairs of the receptacle signal contacts 142. The conductive holders 210 may provide 360° shielding around each pair of receptacle signal contacts. The conductive holders 210 provide shielding from electromagnetic interference (EMI) and/or radio frequency interference (RFI).

Figure 3:
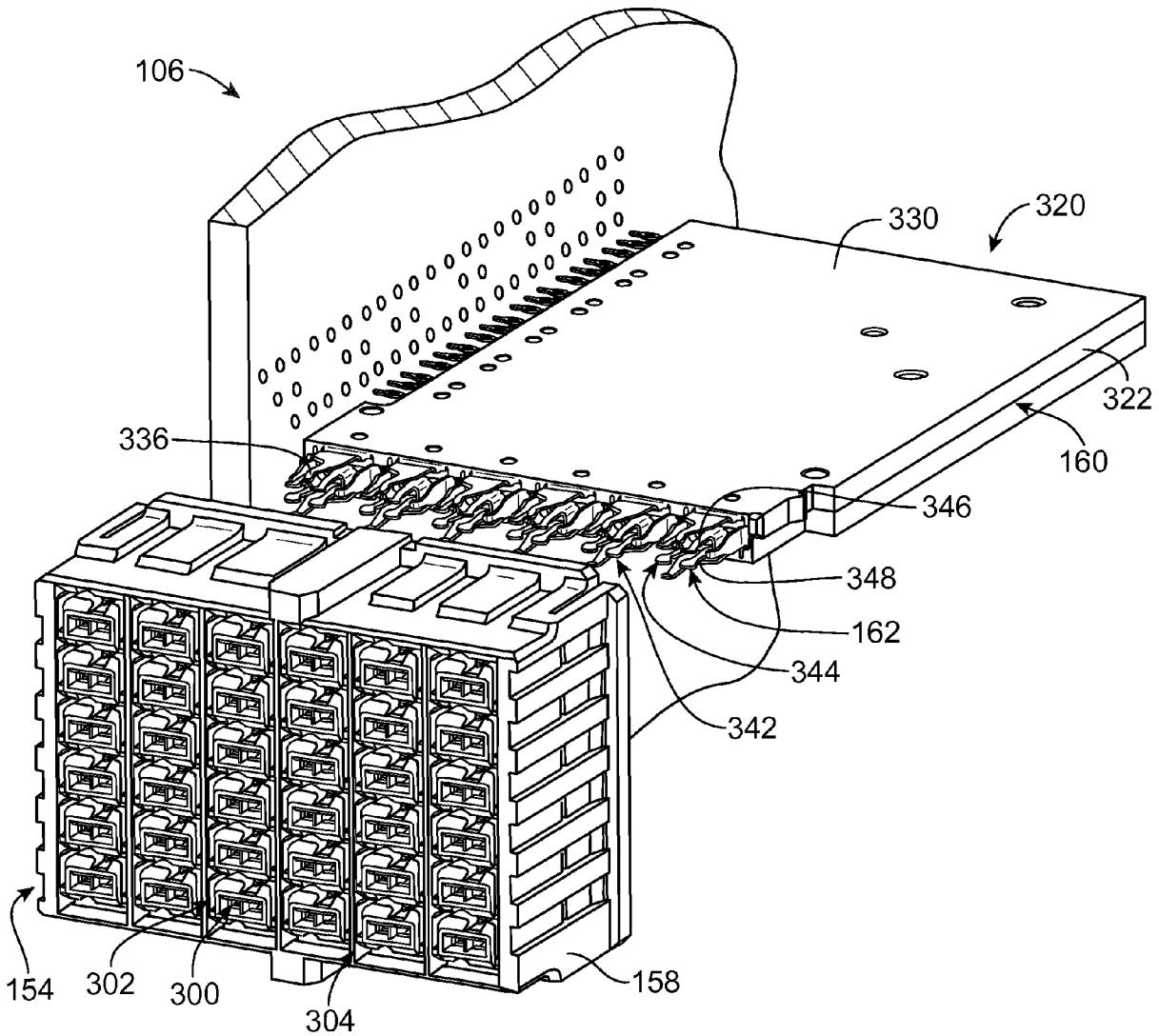
FIG. 3 is a front perspective view of a portion of a second receptacle connector of the electrical connector system formed in accordance with an exemplary embodiment.

FIG. 3 is a front perspective view of a portion of the second receptacle connector 106 formed in accordance with an exemplary embodiment and showing one of the contact modules 160 poised for loading into the second receptacle housing 158. The second receptacle housing 158 is manufactured from a dielectric material, such as a plastic material. The second receptacle housing 158 includes a plurality of signal contact openings 300 and a plurality of ground contacts openings 302 that are through passages that extend from a mating end 304 through the second receptacle housing 158. The mating end 304 defines a portion of the header interface 154 of the second receptacle connector 106.

The contact module 160 is coupled to the second receptacle housing 158 such that the receptacle signal contacts 162 are received in corresponding signal contact openings 300. Optionally, a single receptacle signal contact 162 is received in each signal contact opening 300. The signal contact openings 300 may also receive corresponding header signal contacts 120 (shown in FIG. 1) therein when the receptacle connector 106 is mated with the header transition connector 102 (shown in FIG. 1).

The ground contact openings 302 receive corresponding header ground shields 122 (shown in FIG. 1) therein when the receptacle connector 106 is mated with the header transition connector 102. The ground contact openings 302 receive grounding members, such as grounding contacts 336 of the contact modules 160, which mate with the header ground shields 122. The ground contact openings 302 are C-shaped in the illustrated embodiment to receive the C-shaped header ground shields 122. Other shapes are possible in alternative embodiments, such as when other shaped header ground shields 122 are used.

The contact module 160 includes a frame assembly 320, which includes the receptacle signal contacts 162. The receptacle signal contacts 162 are arranged in pairs carrying differential signals. In an exemplary embodiment, the frame assembly 320 includes a dielectric frame 322 that surrounds the receptacle signal contacts. Optionally, the dielectric frame 322 may be overmolded over a leadframe, which is stamped and formed to define the receptacle signal contacts 162.

The contact module 160 includes a shield 330 that provides shielding for the receptacle signal contacts 162. In an exemplary embodiment, portions of the shield 330 are positioned between pairs of the receptacle signal contacts 162 to provide shielding between adjacent pairs of the receptacle signal contacts 162. The shield 330 provides electrical shielding between and around respective pairs of the receptacle signal contacts 162. The shield 330 includes the grounding contacts 336 that provide shielding for mating portions 342 of the receptacle signal contacts 162. Optionally, the shield 330 may be a multi-piece shield. For example, the grounding contacts 336 may be separately stamped and formed from grounding bars that are mechanically and electrically connected to the base structure of the shield 330. The grounding contacts 336 may extend along three sides of the pair of receptacle signal contacts 162.

The mating portions 342 extend from the front wall of the dielectric frame 322. The mating portions 342 are configured to be mated with and electrically connected to corresponding header signal contacts 120 (shown in FIG. 1). The mating portions 342 within each contact module 160 are arranged in a column. The mating portions 342 define receptacle type mating ends having a receptacle 344 that is configured to receive a pin type contact, such as the header signal contact 120. In the illustrated embodiment, each mating portion 342 is a split beam type of contact having opposed beams 346, 348 defining and flanking the receptacle 344. Other types of mating portions may be provided in alternative embodiments.

The mating portions 342, grounding contacts 336 and second receptacle housing 158 together define the header interface 154. For example, the size and shape of the perimeter of the second receptacle housing 158 as well as the shapes and positions of the mating portions 342 and grounding contacts 336 define the header interface 154. For example, the mating portions 342 have a predetermined pinout defined by the relative positions of the mating portions 342. Optionally, the pinout may be identical to the pinout defined by the first receptacle connector 104 (shown in FIG. 2) such that the first and second receptacle connectors 104, 106 are interchangeable and configured to be mated to either end of the header transition connector 102.

In an exemplary embodiment, the receptacle signal contacts 162 are arranged as differential pairs. In an exemplary embodiment, both receptacle signal contacts 162 of each pair are part of the same contact module 160. The pair of receptacle signal contacts 162 is arranged in the column defined by the contact module 160 and as such the receptacle connector 106 is a pair-in-column receptacle connector 106.

Figure 4:
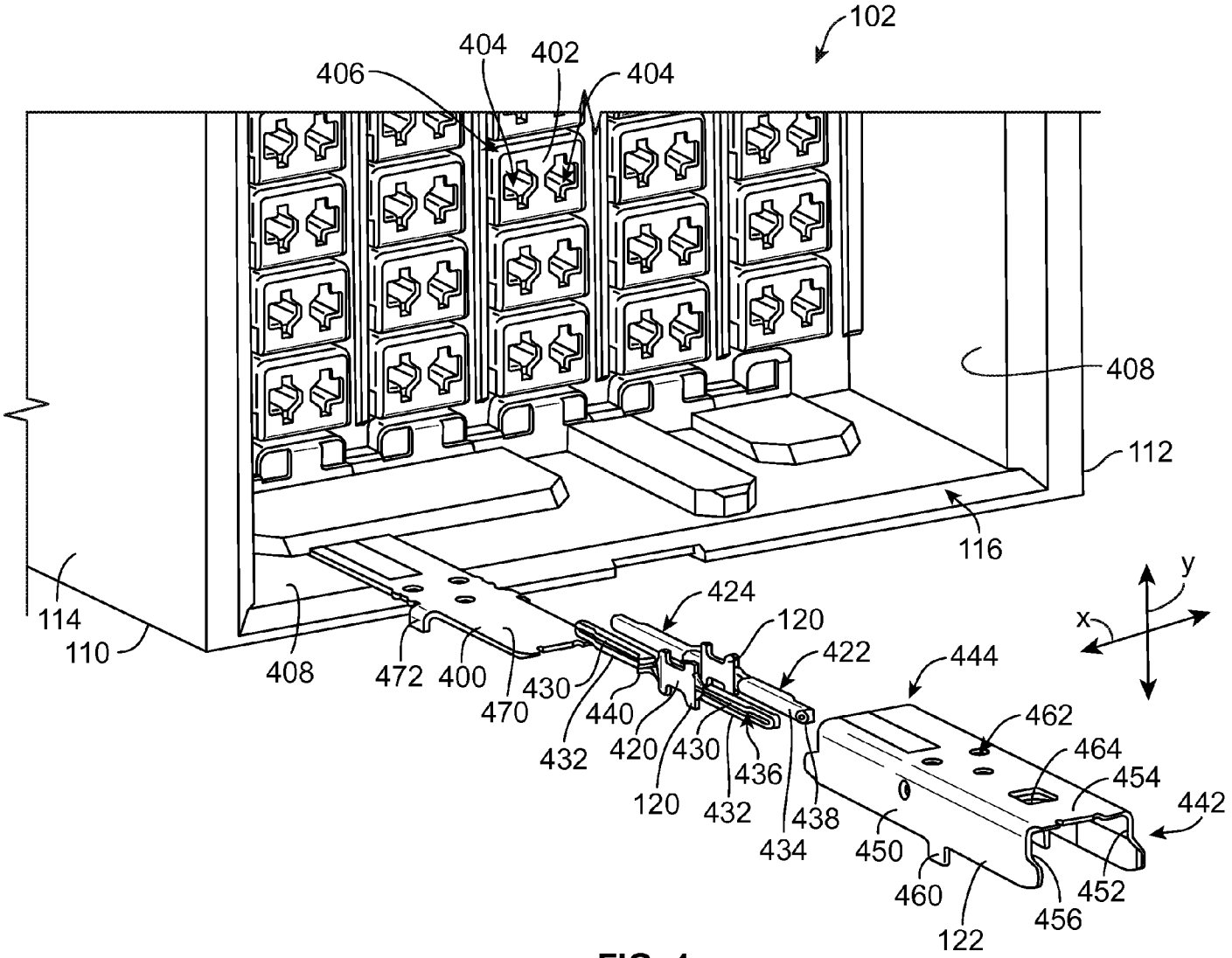
FIG. 4 illustrates a portion of a header transition connector of the electrical connector system formed in accordance with an exemplary embodiment.

FIG. 4 illustrates a portion of the header transition connector 102 showing an orphan ground shield 400, a pair of the header signal contacts 120 and one of the header ground shields 122 poised for loading into the header housing 110. The header housing 110 is manufactured from a dielectric material, such as a plastic material. The header housing 110 includes a separating wall 402 between the first cavity 116 and the second cavity 118 (shown in FIG. 1). The separating wall 402 includes signal contact openings 404 that receive corresponding header signal contacts 120 and ground shield openings 406 that receive corresponding header ground shields 122. The signal contact openings 404 are sized and shaped to hold the header signal contacts 120 therein. The ground shield openings 406 are sized and shaped to hold the header ground shields 122 therein.

The header housing 110 includes shroud walls 408 extending from the separating wall 402 to the first end 112 and the second end 114. The shroud walls 408 define the first and second cavities 116, 118. The shroud walls 408 surround exposed portions of the header signal contacts 120 and the header ground shields 122. The receptacle connectors 104, 106 (both shown in FIG. 1) are configured to be coupled to the shroud walls 408. The shroud walls 408 may guide the receptacle connectors 104, 106 into the cavities 116, 118 during mating.

Optionally, the header signal contacts 120 may be substantially similar. Each header signal contact 120 includes a base section 420, which may be approximately centered along a length of the header signal contact 120. In an exemplary embodiment, the header signal contact 120 is a stamped and formed contact. The base section 420 is configured to be received in the corresponding signal contact opening 404 and held therein, such as by an interference fit.

The header signal contact 120 includes a first mating end 422 extending from one side of the base section 420 and a second mating end 424 extending from the opposite side of the base section 420. The first mating end 422 is configured to extend into the first cavity 116 for mating with the first receptacle connector 104. The second mating end 424 is configured to extend into the second cavity 118 for mating with the second receptacle connector 106. In an exemplary embodiment, the first and second mating ends 422, 424 define pin type contacts having a generally equal width and height (defined in the X and Y directions, respectively).

In an exemplary embodiment, the first and second mating ends 422, 424 are formed into U-shaped pins. For example, with reference to the first mating end 422 (the second mating end 424 may be formed in a similar manner), the pin is formed by bending or rolling an upper shoulder 430 and a lower shoulder 432 with a connecting segment 434 therebetween. The connecting segment 434 may be curved. In the illustrated embodiment, the upper and lower shoulders 430, 432 are generally planar and parallel to one another with a gap 436 therebetween. In alternative embodiments, the upper and lower shoulders 430, 432 may be curved and distal ends of the upper and lower shoulder may abut one another, such as to form a round or O-shaped pin rather than the U-shaped pin shown in the illustrated embodiment. In an exemplary embodiment, a tip 438 is formed at the distal end of the first mating end 422. The tip 438 reduces stubbing with the receptacle signal contact 142 during mating.

The upper and lower shoulders 430, 432 may be compressible toward one another. For example, the upper and lower shoulders 430, 432 may be resiliently deflected by the beams 246, 248 (shown in FIG. 2) of the corresponding receptacle signal contact 142 (shown in FIG. 2) when received in the receptacle 244 (shown in FIG. 2) thereof. The upper shoulder 430 defines an upward facing mating interface for mating with the upper beam 246 of the receptacle signal contact 142. The lower shoulder 432 defines a downward facing mating interface for mating with the lower beam 248 of the receptacle signal contact 142. The upper shoulder 430 and the lower shoulder 432 are both perpendicular to the base section 420.

In an exemplary embodiment, the upper shoulder 430 and the lower shoulder 432 are parallel to corresponding upper and lower shoulders 430, 432 of the second mating end 424. Optionally, the upper shoulder 430 and the lower shoulder 432 are coplanar with the upper and lower shoulders 430, 432 of the second mating end 424. In an exemplary embodiment, the upper and lower shoulders 430, 432 of the second mating end 424 include ramps 440 extending therefrom that are used to control impedance, such as when the second receptacle connector 106 is not fully mated.

The header ground shields 122 are sized and shaped to provide electrical shielding around the pair of header signal contacts 120. The header ground shields 122 each include a first mating end 442 and an opposite second mating end 444. The first mating end 442 is configured to extend into the first cavity 116 for mating with the grounding contacts 236 (shown in FIG. 2) of the first receptacle connector 104. The second mating end 444 is configured to extend into the second cavity 118 (shown in FIG. 1) for mating with the grounding contacts 336 (shown in FIG. 3) of the second receptacle connector 106.

In the illustrated embodiment, the header ground shields 122 are C-shaped and provide shielding on three sides of the pair of header signal contacts 120. The header ground shields 122 have a plurality of walls 450, such as three planar walls 452, 454, 456. The walls 452, 454, 456 may be integrally formed or alternatively, may be separate pieces. The wall 454 defines a center wall or top wall of the header ground shield 122. The walls 452, 456 define side walls that extend from the center wall 454. The side walls 452, 456 may be generally perpendicular with respect to the center wall 454. The bottom of each header ground shield 122 is open between the side walls 452, 456. Either the header ground shield 122 associated with another pair of header signal contacts 120 or the orphan ground shield 400 provides shielding along the open, fourth side such that each of the pairs of header signal contacts 120 is shielded from each adjacent pair in the same column and the same row.

Other configurations or shapes for the header ground shields 122 are possible in alternative embodiments. More or less walls may be provided in alternative embodiments. The walls may be bent or angled rather than being planar. In other alternative embodiments, the header ground shields 122 may provide shielding for individual header signal contacts 120 or sets of contacts having more than two header signal contacts 120.

In an exemplary embodiment, the header ground shield 122 includes tabs 460 extending from the side walls 452, 456. The tabs 460 are used to stop or locate the header ground shield 122 in the ground shield opening 406, such as to limit the amount that the ground shield 122 is loaded into the ground shield opening 406. The tabs 460 may define push surfaces for pushing or loading the header ground shield 122 into the ground shield opening 406. Optionally, the first receptacle connector 104 (shown in FIG. 1) may be positioned immediately behind the tabs 460 when the first receptacle connector 104 is loaded into the first cavity 116 to block the header ground shield 122 from being pushed out of the ground shield opening 406, such as when the second receptacle connector 106 (shown in FIG. 1) is loaded into the second cavity 118.

The header ground shield 122 includes a plurality of interference bumps 462 formed in the walls 450. The interference bumps 462 engage the header housing 110, such as inside the ground shield opening 406, to hold the header ground shield 122 in the ground shield opening 406 by an interference fit.

The header ground shield 122 includes a latch 464. In the illustrated embodiment, the latch 464 extends from the center wall 454; however the latch 464 may extend from another wall. Optionally, multiple latches 464 may be provided. The latch 464 may be stamped from the corresponding wall 450 and bent inward or outward to engage the header housing 110. The latch 464 may be deflectable.

The orphan ground shield 400 includes a single planar wall 470; however the orphan ground shield 400 may include multiple walls in alternative embodiments. The orphan ground shield 400 includes tabs 472 that operate similar to the tabs 460. The orphan ground shield 400 is positioned in the corresponding ground shield opening 406 below the bottom-most pair of header signal contacts 120. The orphan ground shield 400 provides shielding below the bottom-most pair of header signal contacts 120.

Figure 5:
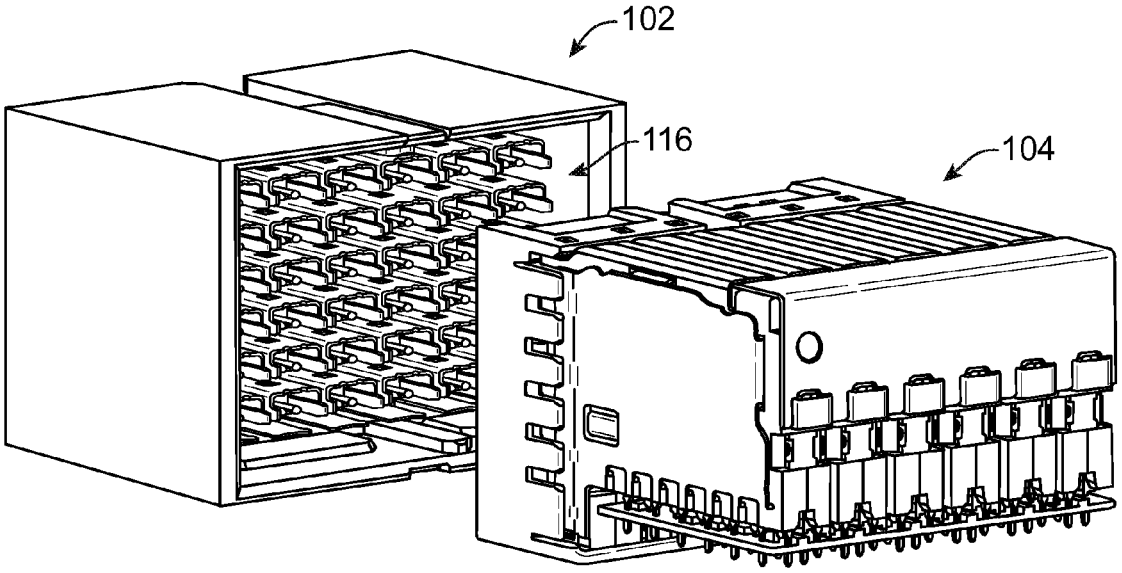
FIG. 5 illustrates the header transition connector poised for mating with the first receptacle connector.

FIG. 5 illustrates the header transition connector 102 poised for mating with the first receptacle connector 104. The header transition connector 102 is loaded in a loading direction. The first receptacle connector 104 is configured to be received in the first cavity 116. Optionally, securing features may be provided to securely couple the header transition connector 102 to the first receptacle connector 104. Guide features may be provided to guide mating.

Figure 6:
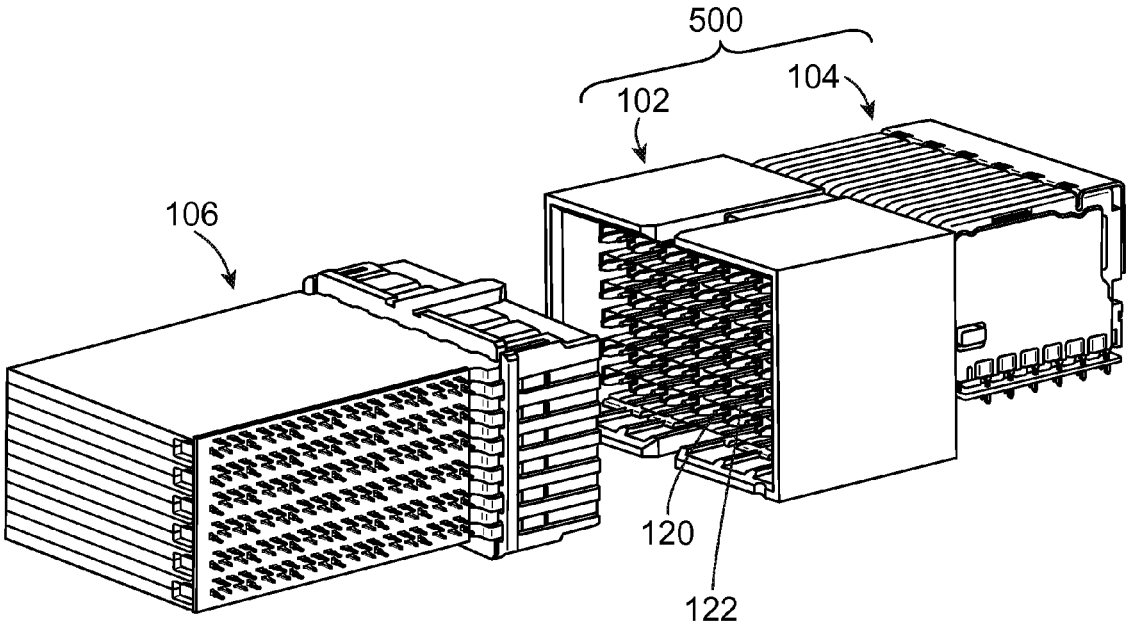
FIG. 6 is a front perspective view of the header transition connector coupled to the first receptacle connector to form a header assembly.

FIG. 6 is a front perspective view of the header transition connector 102 coupled to the first receptacle connector 104 to form a header assembly 500. The header signal contacts 120 are arranged in an array in rows and columns having a pinout that is complementary to the pinout of the receptacle signal contacts 142 and 162 of the first and second receptacle connectors 104, 106 (shown in FIG. 3). For example, the pinouts are defined by the horizontal and vertical spacings between the corresponding signal contacts 120, 142, 162 (for example, the centerline spacings) and the horizontal and vertical spacings from the signal contacts 120, 142, 162 to the header ground shields 122 (for example, the centerline spacings). The pinouts of the header transition connector 102 are complementary (for example, matching) to the pinouts of the receptacle connectors 104, 106 to allow mating and interchangeability of the receptacle connectors 104, 106 into either end of the header transition connector 102. Optionally, the pinout of the header transition connector 102 may be identical to the pinout defined by the receptacle connectors 104, 106 such that the first and second receptacle connectors 104, 106 are interchangeable and configured to be mated to either end of the header transition connector 102.

In an exemplary embodiment, the header transition connector 102 is coupled to the first receptacle connector 104 prior to mating with the second receptacle connector 106. Optionally, the header assembly 500 may form part of an electrical system, such as a backplane, a network switch, and the like, where many header assemblies 500 are arranged together, such as inside a chassis or rack. One or more second receptacle connectors 106 may be coupled to the header assemblies 500 as part of line or switch cards. The header transition connectors 102, by being coupled directly to the first receptacle connectors 104, allow for mating of the second receptacle connectors 106 to the first receptacle connectors 104 without the need for a midplane circuit board. The header transition connectors 102 change the mating interfaces from receptacle interfaces to pin interfaces for mating with the second receptacle connectors 106.

Figure 7:
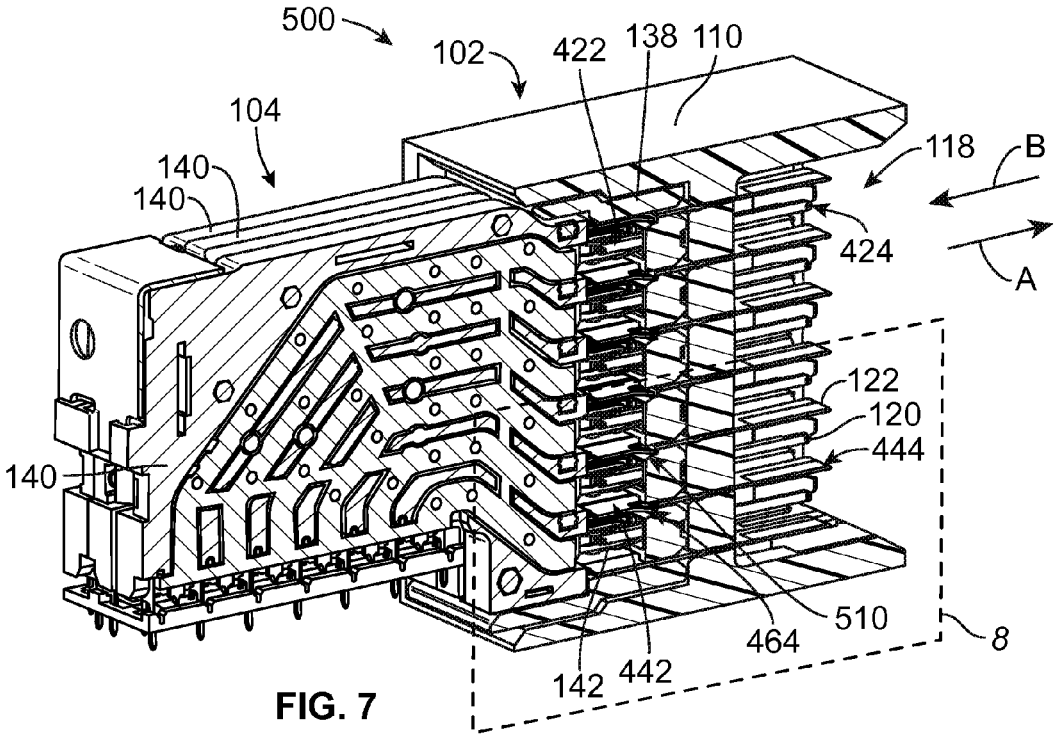
FIG. 7 is a partial sectional view of the header transition connector coupled to the first receptacle connector to form the header assembly.
Figure 8:
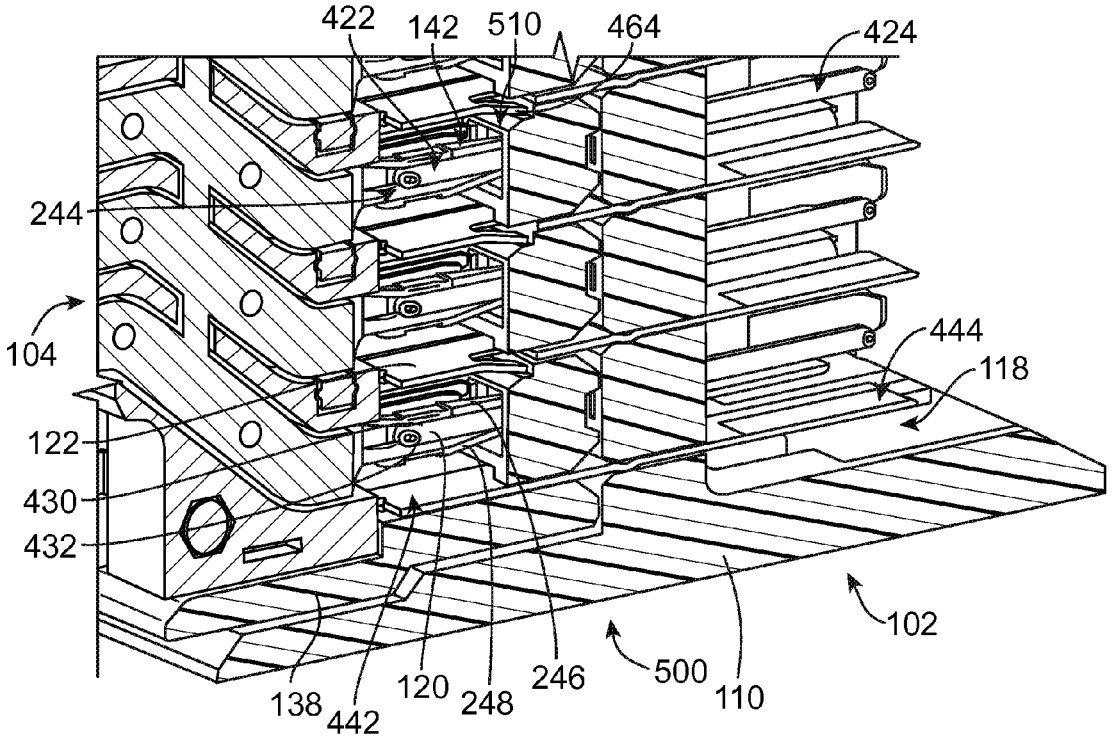
FIG. 8 is an enlarged view of a portion of the header transition connector and first receptacle connector taken within boundary line 8 in FIG. 7.

FIG. 7 is a partial sectional view of the header transition connector 102 coupled to the first receptacle connector 104 to form the header assembly 500. FIG. 7 illustrates the header ground shields 122 loaded into the header housing 110. FIG. 8 is an enlarged view of a portion of the header transition connector 102 and first receptacle connector 104 shown within boundary line 8 in FIG. 7.

The header ground shields 122 extend an entire length of the header signal contacts 122 from the tip of the first mating end 422 to the tip of the second mating end 424. Optionally, because the first receptacle connector 104 is securely coupled to the header transition connector 102 as a header assembly 500, the first mating ends 422 of the header signal contacts 120 and the first mating ends 442 of the header ground shields 122 do not have the same mating and unmating requirements and built-in tolerances as the second mating ends 424, 444. As such, the first mating ends 422 of the header signal contacts 120 may be shorter than the second mating ends 424 of the header signal contacts 120, and the first mating ends 442 of the header ground shields 122 may be shorter than the second mating ends 444 of the header ground shields 122. As such, a reduction in the amount of material may result. The amount of plating, such as gold plating, may be reduced. The amount of electrical stub may be reduced.

The latches 464 are received in pockets 510 in the first receptacle housing 138. The latches 464 may lock the header ground shields 122 in the first receptacle connector 104, which may lock the first receptacle connector 104 in the header transition connector 102. Other types of latches or securing means may be used in alternative embodiments to secure the first receptacle connector 104 to the header transition connector 102, such as external latches, fasteners, and the like.

The latches 464 secure the header ground shields 122 in position. For example, the latches 464 stop the header ground shields 122 from being pulled out of the header housing 110 through the second cavity 118, such as in the direction of arrow A. The tabs 460 (shown in FIG. 4) may stop the header ground shields 122 from moving in the direction of arrow A. In an exemplary embodiment, the first receptacle connector 104 blocks the header ground shields 122 from being pushed out of the header housing 110, such as in the direction of arrow B. For example, the tips of the first mating ends 442 abut against the front of the corresponding contact module 140 to block the header ground shields 122. The tabs 460 (shown in FIG. 4) may abut against the front of the corresponding contact module 140 to block the header ground shields 122.

The first mating ends 422 are shown in the receptacles 244 of the receptacle signal contacts 142. The upper beams 246 (shown in FIG. 8) engage corresponding upper shoulders 430 (shown in FIG. 8) of the header signal contacts 122. The lower beams 248 (shown in FIG. 8) engage corresponding lower shoulders 432 (shown in FIG. 8) of the header signal contacts 122.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A header transition connector comprising:

a header housing having a first end and a second end, the header housing having a separating wall separating a first cavity from a second cavity at the first and second ends, respectively, the separating wall having signal contact openings and ground shield openings therethrough;

header signal contacts held in corresponding signal contact openings, the header signal contacts arranged in pairs carrying differential signals, the header signal contacts having first mating ends in the first cavity for mating with a first receptacle connector, the header signal contacts having second mating ends in the second cavity for mating with a second receptacle connector, the header signal contacts pass straight through the separating wall such that the first mating ends are aligned coplanar with the second mating ends on opposite sides of the separating wall, wherein the first mating end of each header signal contact is formed into a U-shape and wherein the second mating end of each header signal contact is formed into a U-shape; and header ground shields held in corresponding ground shield openings, the header ground shields having walls surrounding associated pairs of header signal contacts on at least two sides thereof, the header ground shields having first mating ends in the first cavity for mating with the first receptacle connector, the header ground shields having second mating ends in the second cavity for mating with the second receptacle connector;

wherein the header housing has shroud walls extending from the separating wall to the first end and to the second end to define the first and second cavities and receive the first and second receptacle connectors, the shroud walls extend beyond the header signal contacts and the header ground contacts to protect the header signal contacts and the header ground contacts.

2. The header transition connector of claim 1, wherein the walls of the header ground shields surround the associated pair of header signal contacts on three sides.

3. The header transition connector of claim 1, wherein the header ground shields are C-shaped.

4. The header transition connector of claim 1, wherein the header ground shields extend an entire length of the header signal contacts.

5. The header transition connector of claim 1, wherein the header ground shields includes latches configured to engage the first receptacle connector and lock the header ground shields in the first receptacle connector.

6. The header transition connector of claim 1, wherein the header signal contacts define U-shaped pins at the first mating ends and the second mating ends.

7. The header transition connector of claim 1, wherein the first mating ends of the header signal contacts are arranged in an array in rows and columns having a predetermined pinout, and wherein the second mating ends of the header signal contacts are arranged in an array in rows and columns having a predetermine pinout identical to the pinout of the first mating ends.

8. The header transition connector of claim 1, wherein the first mating ends of the header signal contacts are shorter than the second mating ends of the header signal contacts and wherein the first mating ends of the header ground shields are shorter than the second mating ends of the header ground shields.

9. An electrical connector system comprising:

a receptacle connector comprising a receptacle housing and contact modules coupled to the receptacle housing, the contact modules each comprising receptacle signal contacts arranged in pairs carrying differential signals, the contact modules each comprising a ground shield having ground contacts extending therefrom and providing electrical shielding for associated pairs of the receptacle signal contacts, the receptacle signal contacts being arranged in an array in rows and columns having a predetermined pinout, the receptacle signal contacts being split beam type contacts defining receptacles configured to receive pin type contacts, wherein the ground contacts, receptacle signal contacts and receptacle housing defining a mating interface; and a header transition connector coupled to the receptacle connector, the header transition connector comprising a header housing holding header signal contacts and header ground shields, the header housing having a first end and a second end, the header housing having a separating wall separating a first cavity from a second cavity at the first and second ends, respectively, wherein the receptacle connector is received in the first cavity, the separating wall having signal contact openings receiving corresponding header signal contacts and ground shield openings receiving corresponding header ground shields, the header signal contacts arranged in pairs carrying differential signals, the header signal contacts having first mating ends defining pin type contacts in the first cavity for mating with the receptacle signal contacts of the receptacle connector, the header signal contacts having second mating ends defining pin type contacts in the second cavity, the header signal contacts pass straight through the separating wall such that the first mating ends are aligned coplanar with the second mating ends on opposite sides of the separating wall, wherein the first mating end of each header signal contact is formed into a U-shape and wherein the second mating end of each header signal contact is formed into a U-shape, the header ground shields having walls surrounding associated pairs of header signal contacts on at least two sides thereof, the header ground shields having first mating ends in the first cavity for mating with the ground contacts of the receptacle connector, the header ground shields having second mating ends in the second cavity for mating with a second receptacle connector;

wherein the header housing has shroud walls extending from the separating wall to the first end and to the second end to define the first and second cavities and receive the first and second receptacle connectors, the shroud walls extend beyond the header signal contacts and the header ground contacts to protect the header signal contacts and the header ground contacts;

wherein the first mating ends of the header signal contacts are arranged in an array in rows and columns having a pinout that is complementary to the pinout of the receptacle signal contacts and the second mating ends of the header signal contacts are arranged in an array in rows and columns having a predetermine pinout identical to the pinout of the first mating ends; and wherein the header housing defines a mating interface that is different than the mating interface defined by the receptacle connector and configured to be mated with the second receptacle connector.

10. The electrical connector system of claim 9, wherein the header transition connector is coupled to the receptacle connector to change from the mating interfacing having split beam type contacts to the mating interface having pin type contacts for mating with the second receptacle connector.

11. The electrical connector system of claim 9, wherein the receptacle connector is mounted to a first circuit board, the receptacle signal contacts being arranged with each of the pairs in the rows and the rows being parallel to a mounting surface of the first circuit board.

12. The electrical connector system of claim 9, wherein the receptacle connector is mounted to a first circuit board, the receptacle signal contacts being arranged with each of the pairs in the columns and the columns being perpendicular to a mounting surface of the first circuit board.

13. An electrical connector system comprising:

a header transition connector comprising a header housing holding header signal contacts and header ground shields, the header housing having a first end and a second end, the header housing having a separating wall separating a first cavity from a second cavity at the first and second ends, respectively, the separating wall having signal contact openings receiving corresponding header signal contacts and ground shield openings receiving corresponding header ground shields, the header signal contacts arranged in pairs carrying differential signals, the header signal contacts having first mating ends in the first cavity, the header signal contacts having second mating ends in the second cavity, wherein the first mating end of each header signal contact is formed into a U-shape and wherein the second mating end of each header signal contact is formed into a U-shape, the first mating ends of the header signal contacts being arranged in an array in rows and columns having a predetermined pinout and the second mating ends of the header signal contacts are arranged in an array in rows and columns having a predetermine pinout identical to the pinout of the first mating ends, the pairs of header signal contacts being arranged in corresponding rows, the rows of the header signal contacts in the first cavity are parallel with the rows of the header signal contacts in the second cavity, the header ground shields having walls surrounding associated pairs of header signal contacts on at least two sides thereof, the header ground shields having first mating ends in the first cavity, the header ground shields having second mating ends in the second cavity;

a first receptacle connector received in the first cavity, the first receptacle connector having first receptacle signal contacts mated with the first mating ends of corresponding header signal contacts, the first receptacle connector having first ground contacts mated with the first mating ends of corresponding header ground shields; and a second receptacle connector received in the second cavity, the second receptacle connector having second receptacle signal contacts mated with the second mating ends of corresponding header signal contacts, the second receptacle connector having second ground contacts mated with the second mating ends of corresponding header ground shields.

14. The electrical connector system of claim 13, wherein the first and second receptacle connectors are identical.

15. The electrical connector system of claim 13, wherein the first receptacle connector is mounted to a first circuit board, the first receptacle signal contacts being arranged in rows and in columns, the first receptacle signal contacts being arranged in pairs carrying differential signals, the pairs being arranged in the rows and being parallel to a mounting surface of the first circuit board.

16. The electrical connector system of claim 15, wherein the second receptacle connector is mounted to a second circuit board, the second receptacle signal contacts being arranged in rows and in columns, the second receptacle signal contacts being arranged in pairs carrying differential signals, the pairs being arranged in the columns and being perpendicular to a mounting surface of the second circuit board.

17. The electrical connector system of claim 15, wherein the second receptacle connector is mounted to a second circuit board, the second receptacle signal contacts being arranged in rows and in columns, the second receptacle signal contacts being arranged in pairs carrying differential signals, the pairs being arranged in the rows and being parallel to a mounting surface of the second circuit board.

18. The electrical connector system of claim 13, wherein the first receptacle connector is mounted to a first circuit board and the second receptacle connector is mounted to a second board, the first receptacle connector being received in the first cavity such that the first circuit board is oriented horizontally, the second receptacle connector being received in the second cavity such that the second circuit board is oriented vertically.

19. The electrical connector system of claim 13, wherein the first receptacle connector is mounted to a first circuit board and the second receptacle connector is mounted to a second circuit board, the first receptacle connector being received in the first cavity such that the first circuit board is oriented horizontally, the second receptacle connector being received in the second cavity such that the second circuit board is oriented horizontally.

* * * * *